US011143049B2

(12) United States Patent
Pellaton et al.

(10) Patent No.: US 11,143,049 B2
(45) Date of Patent: Oct. 12, 2021

(54) LABYRINTH SEAL COMPRISING A LIP PROVIDED WITH A DEFLECTOR

(71) Applicant: SAFRAN HELICOPTER ENGINES, Bordes (FR)

(72) Inventors: Bertrand Guillaume Robin Pellaton, Moissy-Cramayel (FR); Lucas Benassis, Moissy-Cramayel (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 0 days.

(21) Appl. No.: 16/763,390

(22) PCT Filed: Nov. 16, 2018

(86) PCT No.: PCT/IB2018/001314
§ 371 (c)(1),
(2) Date: May 12, 2020

(87) PCT Pub. No.: WO2019/097286
PCT Pub. Date: May 23, 2019

(65) Prior Publication Data

US 2021/0062668 A1 Mar. 4, 2021

(30) Foreign Application Priority Data

Nov. 15, 2017 (FR) ..... 1760758

(51) Int. Cl.
*F01D 11/02* (2006.01)
*F01D 11/08* (2006.01)

(52) U.S. Cl.
CPC ..... *F01D 11/02* (2013.01); *F01D 11/08* (2013.01); *F05D 2240/55* (2013.01)

(58) Field of Classification Search
CPC ..... F01D 5/225; F01D 11/02; F01D 11/08; F01D 11/127; F05D 2240/55
See application file for complete search history.

(56) References Cited

U.S. PATENT DOCUMENTS 6,478,304 B1 * 11/2002 Hoffelner ..... F01D 11/02 277/415
6,890,150 B2 * 5/2005 Tomberg ..... F01D 5/141 277/415
7,857,581 B2 * 12/2010 Mons ..... F01D 11/02 415/173.5
9,797,264 B2 * 10/2017 Boeck ..... F01D 5/288
(Continued)

FOREIGN PATENT DOCUMENTS

EP 2116692 A2 11/2009
FR 2825411 A1 12/2002
(Continued)

OTHER PUBLICATIONS

Search Report issued in French Patent Application No. 1760758 dated Jun. 19, 2018.
(Continued)

*Primary Examiner* — Igor Kershteyn
(74) *Attorney, Agent, or Firm* — Pearne & Gordon LLP

(57) ABSTRACT

A labyrinth seal lip (5) comprises, standing on one of its lateral faces (7), a deflector (13) which channels the flow of gas tangent to the lip (5) towards the facing seal (4) so as to disturb the leakage flow (22) through the gap and decrease the flow rate.

7 Claims, 2 Drawing Sheets

(56) References Cited

U.S. PATENT DOCUMENTS

| | | | | |
|---|---|---|---|---|
| 2004/0146404 | A1* | 7/2004 | Chantal | F01D 11/08 416/224 |
| 2009/0280011 | A1* | 11/2009 | Tibbott | F01D 11/02 416/95 |
| 2012/0027573 | A1* | 2/2012 | Ali | F01D 11/02 415/173.1 |

FOREIGN PATENT DOCUMENTS

| | | | |
|---|---|---|---|
| FR | 2963403 | A1 | 2/2012 |
| FR | 2980234 | A1 | 3/2013 |
| WO | 2017098944 | A1 | 6/2017 |

OTHER PUBLICATIONS

International Search Report issued in Application No. PCT/IB2018/001314 dated Mar. 28, 2019.
Written Opinion issued in Application No. PCT/IB2018/001314 dated Mar. 28, 2019.

* cited by examiner

LABYRINTH SEAL COMPRISING A LIP PROVIDED WITH A DEFLECTOR

This is the National Stage application of PCT international application PCT/IB2018/001314, filed on Nov. 16, 2018 entitled "LABYRINTH SEAL COMPRISING A LIP PROVIDED WITH A DEFLECTOR", which claims the priority of French Patent Application No. 17/60758 filed Nov. 15, 2017, both of which are incorporated herein by reference in their entirety.

The subject of this invention is a labyrinth seal comprising a lip provided with a deflector.

Labyrinth seals are well known and are very frequently used, for example in the aeronautical industry. They tolerate a small leakage flow passing through them. They normally separate chambers containing gases at different pressures, they are located in succession along a rotor and a stator facing the rotor, or more generally two structures with different rotations. The labyrinth seals described herein comprise a base fixed to one of the structures and carrying at least one lip, in other words a circular ridge standing up above the base and the vertex of which is directed towards the other of the structures, that can support a seal packing material such as a honeycomb, very close to the tip of the lip, or another material said to be abradable that the lip can easily erode when the clearance disappears in case of differential thermal expansions, for example between the rotor and the stator, or during sudden accelerations generating large centrifugal displacements. The leakage flow is reduced by the narrowness of the clearance between the tip of the lip and the packing material facing the lip, and by the sudden change in section accessible to the leakage flow, created by the lip. This sudden change effect is reinforced in the usual case in which there are several lips in succession along the flow direction.

Although a leakage flow is tolerated and inevitable with labyrinth seals, efforts are always made to reduce it through the use of special lip shapes, among other means. Documents FR 2 980 234 A and FR 2 825411 A form part of prior art in this technical field, and illustrate the very frequent use of labyrinth seals at the free end of turbomachine blades and in the case of the last blades, special sawtooth construction of the lips in succession along the tangential direction, so as to facilitate the manner in which the lips engage on the packing material, while absorbing less rotor power, when the clearance between the packing material and the lips disappears.

Document FR 2 825 411 A1 describes a lip composed of segments with a variable height (along the radiation direction); EP 2 116 692 A2 describes lips that can be composed of segments curved along the axial direction of the rotor; U.S. Pat. No. 6,478,304 B1 describes a lip provided with cutting elements projecting from the lateral faces and the face of the tip of the lip; and FR 2 963 403 A1 describes lips provided with lateral deflectors, but on a stator.

The fundamental purpose of this invention is to further reduce leakage flows passing through labyrinth seals, making use of an innovation in the design of the lips.

One general aspect of the invention is a labyrinth seal of a turbomachine, the seal comprising at least one lip projecting above the base of a rotor of the turbomachine, the lip being circular and extending along a direction called the tangential direction, comprising two lateral faces each connected to the base and, at an end opposite the base, at a face at the tip of the lip at which at least one of the lateral faces supports at least one deflector comprising a deflecting face intersecting with said lateral face and with an inclination relative to the tangential direction. And the inclination of the deflecting face relative to the tangential direction increases with decreasing distance from the face of the tip, the deflecting face thus being concave.

The deflector is a structure projecting on a lateral side of the lip and having a face called the deflecting face directed along the tangential direction of the rotor so as to intercept part of the flow that is locally along a direction with a preponderant radial component because it flows along this lateral side of the lip, to deviate it by increasing its tangential component so as to disturb the leakage flow along the principally axial and perpendicular direction, and therefore to reduce its flow. The concaveness of the deflecting flow increases the particularly beneficial tangential component.

According to some preferred forms of the invention:

- the deflector is repeated along the lip at a regular angular pitch along the tangential direction;
- the lip is free to move along the tangential direction and the deflecting face is directed along a movement direction of the lip;
- the deflecting face being between the base and the tip face;
- the lateral face supporting the deflector is directed towards the upstream side of a flow passing through the labyrinth seal along an axial direction perpendicular to the tangential direction;
- the lip is inclined from the base, towards the upstream side of a flow passing through the labyrinth seal along an axial direction perpendicular to the tangential direction.

These different possible modifications and improvements can all reinforce the effect of the general arrangement.

The invention will now be described in detail with reference to the following figures that represent one particular embodiment, appended purely for illustrative purposes:

Figure 5:
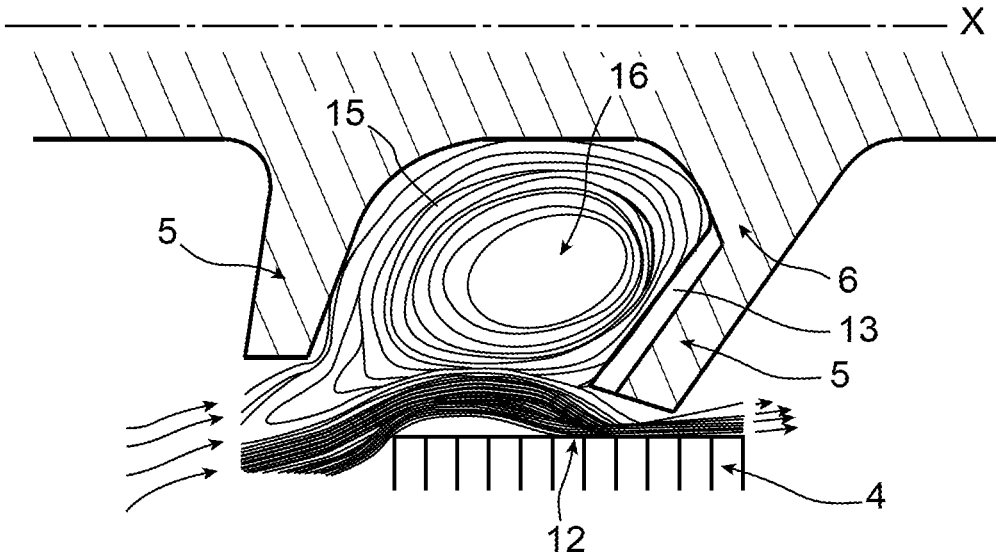

and FIG. 5 illustrates the flow that passes through the seal.

Figure 1:
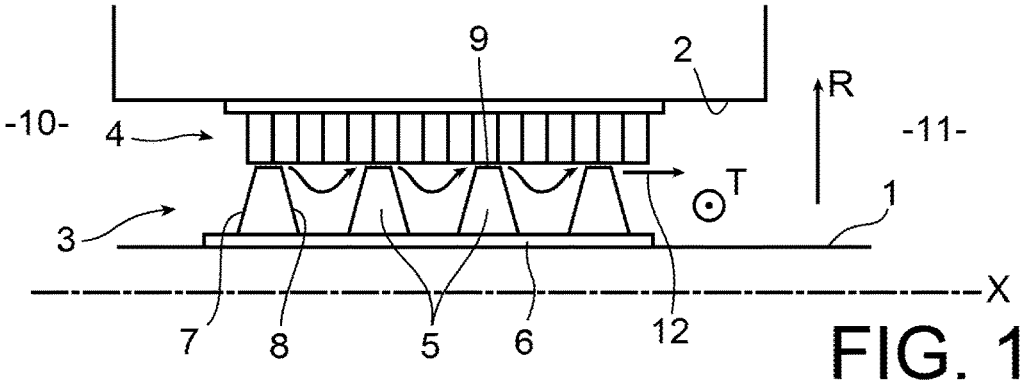
FIGS. 1 and 2 represent an axial section and a cross-section of a normal labyrinth seal.
Figure 2:
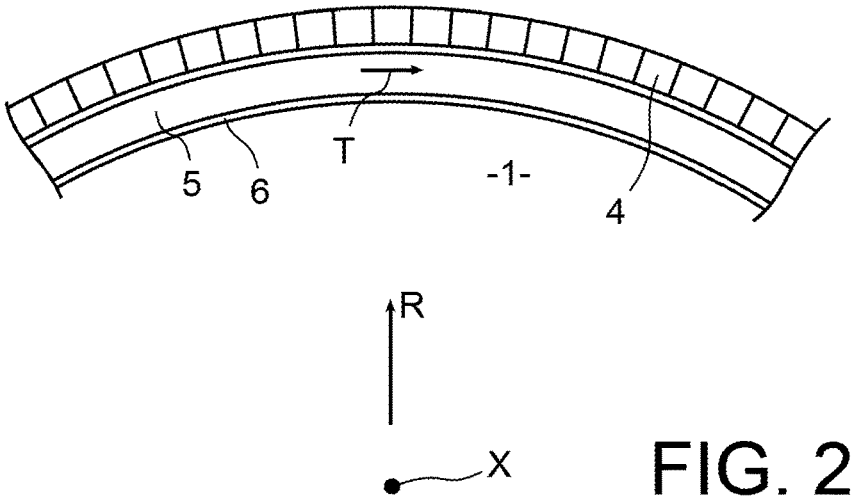

FIGS. 1 and 2 represent an axial section and a cross-section of a classical labyrinth seal; A rotor shaft 1 extending along an axial direction X of a turbomachine is surrounded by a stator 2. The labyrinth seal 3 comprises a seal packing material 4 that may be in the form of a honeycomb fixed to the stator 2, and lips 5 projecting from a base 6 fixed to the rotor 1. The lips 5 project along a radial direction R of the machine and extend along a tangential direction T, these three directions being perpendicular to each other. The stator 2 and the seal packing 4 are annular, the lips 5 are circular around the central axis of the machine. Each of the lips 5 is delimited by two lateral faces 7 and 8 connected to the base 6, and by a tip face 9, that can be a single edge, being connected to opposite ends of the lateral faces 7 and 8. The labyrinth seal 3 separates two gas chambers 10 and 11 in succession along the rotor 1 and delimited by the rotor 1 and by the stator 2. If the pressure in one of the chambers 10 is higher than the pressure in the other, a leakage flow 12 is set up through the labyrinth seal 3, through the clearances between the faces of the tips 9 of the lips 5 and the seal packing material 4. The lateral face 7 is directed towards the upstream side of the leakage flow 12, and the lateral face 8 is directed towards the downstream side for each of the lips 5.

According to the invention (FIGS. 3, 4 and 5), the lips 4 are provided with deflectors 13 at at least one of their lateral faces and particularly at the lateral face 7 directed towards the upstream side of the leakage flow 12, these deflectors possibly consisting of platelets and in all cases comprising a deflecting face 14 intersecting the lateral face 7 on which the deflectors are installed, and directed along the movement direction r of the rotor 1 along the tangential direction T. The deflectors 13 can be installed at a regular angular pitch along the tangential direction T along the lip 5. The deflecting faces 14 are inclined related to the tangential direction 5, in other words they extend over at least part of the height of the lip 5 between the base 6 and the face of the tip 9 along the radial direction R, and advantageously over this entire height. This inclination is variable, smaller close to the base 6 (in other words the deflecting face 13 is almost horizontal along the tangential direction T) and then continuously increasing as the distance from the vertex face 9 decreases (in other words the angle from the radial direction R continuously reduces): the deflecting face 14 is concave.

The effect of the deflector 13 can be explained as follows. The leakage flow 12 is in the form of a vortex 15 in front of the lip 5, especially if the lip 5 is preceded by another lip of the same nature, delimiting a cavity 16 forming the vortex 15. The regions of the vortex 15 that are close to the lip 5 receive a large tangential velocity component imposed by the movement of the rotor 1. Arriving in front of the deflecting face 14 of one of the deflectors 13, they are directed by the deflecting face and their direction is changed to induce a large radial velocity component directed towards the seal packing material 4. Therefore the fraction of leakage flow 12 that might pass through the lip 5 collides with this gas deviated by the deflectors 13 and that thus has a large radial component and tangential component. The flow fraction is then disturbed, which reduces the leakage flow through the lip 5. The tangential component, consolidated by the change in inclination of the deflector 13, is considered to be the most useful to produce this effect.

The radial component imposed on the gas intercepted by the deflectors 13 is centrifugal in this case, the rotor 1 being central and surrounded by the stator 2 (or more generally by the body supporting the seal packing material 4). An inverse arrangement would also be possible in which the rotor supports lips surrounding the stator, and the deflectors would then carry lips placed to impose a centripetal radial component on the gas.

Deflectors 13' (FIG. 3) could also be placed on the lateral face 8 of the lips directed towards the downstream side of the leakage flow 12, in addition to or replacing the deflectors 13 described herein; their shape can be identical.

Figure 3:
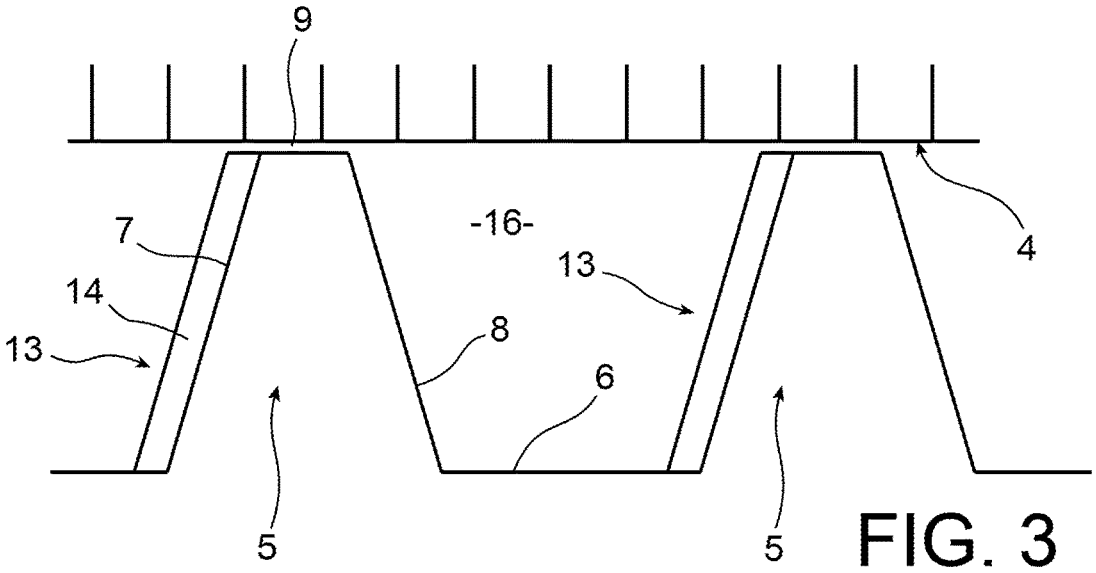
FIGS. 3 and 4 represent an axial section and a cross-section of a seal modified according to the invention.
Figure 4:
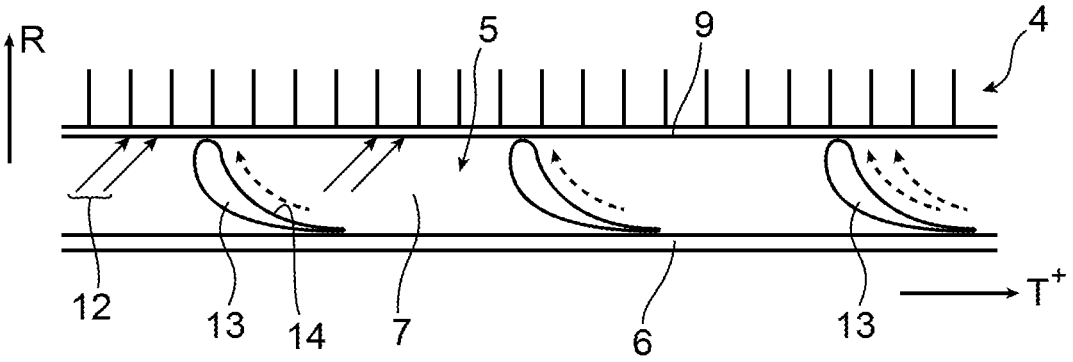

The lips 5 could be inclined along the axial direction without any change for the invention, as is shown on FIG. 5 (in which they are inclined towards the upstream side of the leakage flow 12 from the base 6) or straight (projecting along the purely radial direction), as shown on FIG. 3; furthermore the inclination of the side faces 7 and 8 along the axial direction is not a critical parameter).

For example, there can be a few tens or more than a hundred deflectors 13 along the angular direction, with an angular pitch that can vary from about 2° to 10°. In the case in which the seal is located at the tips of a fixed or mobile blades stage on a ring connecting these tips together, as occurs frequently in turbomachines, the angular pitch of the deflectors 13 can be exactly the same as that of the blades.

What is claimed is:

1. A labyrinth seal of a turbomachine, the seal comprising:

a lip (5) projecting above a base (6) of a rotor (1) of the turbomachine, the lip (5) being circular and extending along a tangential direction (T), wherein the lip (5) comprises two lateral faces (7, 8), each lateral face (7, 8) being connected to the base (6) and, at an end opposite the base (6), a face at a tip (9) of the lip (5) at which, and wherein at least one of the lateral faces (7, 8) supports at least one deflector (13) comprising a deflecting face (14) intersecting with said lateral face (7, 8) and with an inclination relative to the tangential direction (T), wherein the inclination of the deflecting face (14) relative to the tangential direction (T) increases with decreasing distance from the face at the tip (9), the deflecting face (14) thus being concave.

2. The labyrinth seal according to claim 1, wherein the deflector (13) is repeated on the lip at a regular angular pitch along the tangential direction (T).

3. Labyrinth The labyrinth seal according to claim 2, wherein the angular pitch is between 2° and 10°.

4. The labyrinth seal according to claim 1, wherein the lip (5) is configured to move along the tangential direction and the deflecting face (14) is directed towards a movement direction (T+) of the lip (5).

5. The labyrinth seal according to claim 1, wherein the deflecting face (14) extends from the base (6) up to the tip face (9).

6. The labyrinth seal according to claim 1, wherein the lateral face (7, 8) supporting the deflector (13) is directed towards an upstream side of a flow passing through the labyrinth seal along an axial direction (X) perpendicular to the tangential direction (T).

7. The labyrinth seal according to claim 1, wherein the lip (5) is inclined from the base (6), towards an upstream side of a flow (12) passing through the labyrinth seal along an axial direction (X) perpendicular to the tangential direction (T).

* * * * *